US010176668B2

(12) United States Patent
Galasso et al.

(10) Patent No.: US 10,176,668 B2
(45) Date of Patent: Jan. 8, 2019

(54) GAMES AND GAMING MACHINES HAVING GAME SYMBOL REPLACEMENT FEATURE

(71) Applicant: AGS, LLC, Las Vegas, NV (US)

(72) Inventors: Emilio Galasso, Nobleton (CA); Yi-Chen Chang, Vaughan (CA)

(73) Assignee: AGS LLC, Las Vegas, NV (US)

( * ) Notice: Subject to any disclaimer, the term of this patent is extended or adjusted under 35 U.S.C. 154(b) by 254 days.

(21) Appl. No.: 14/747,580

(22) Filed: Jun. 23, 2015

(65) Prior Publication Data

US 2016/0379439 A1 Dec. 29, 2016

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3227* (2013.01); *A63F 9/24* (2013.01); *G07F 17/3213* (2013.01); *G07F 17/34* (2013.01); *A63F 2009/245* (2013.01)

(58) Field of Classification Search

CPC ... G07F 17/34; G07F 17/3213; G07F 17/3227
See application file for complete search history.

(56) References Cited

U.S. PATENT DOCUMENTS

| | | | | |
|---|---|---|---|---|
| 6,805,632 | B2 | 10/2004 | Suda | |
| 7,553,231 | B2 | 6/2009 | Rodgers et al. | |
| 7,758,414 | B1 | 7/2010 | Marks et al. | |
| 8,002,625 | B2 | 8/2011 | Maya | |
| 8,292,724 | B2 | 10/2012 | Marks et al. | |
| 8,784,176 | B2 | 7/2014 | Ryan | |
| 2005/0164775 | A1* | 7/2005 | Rodgers | G07F 17/34 463/20 |
| 2006/0030392 | A1* | 2/2006 | Rodgers | G07F 17/3265 463/16 |
| 2006/0068892 | A1* | 3/2006 | Gomez | G07F 17/34 463/20 |
| 2006/0258434 | A1* | 11/2006 | Jaffe | G07F 17/3244 463/16 |
| 2008/0081687 | A1* | 4/2008 | Blumel | G07F 17/34 463/20 |
| 2008/0153570 | A1* | 6/2008 | Esses | G07F 17/3295 463/20 |
| 2009/0286592 | A1* | 11/2009 | Vann | G07F 17/3267 463/20 |
| 2011/0053676 | A1* | 3/2011 | Wolf | G07F 17/3258 463/20 |

(Continued)

*Primary Examiner* — Steve Rowland
(74) *Attorney, Agent, or Firm* — Weide & Miller, Ltd.

(57) ABSTRACT

A slot-type game and a gaming machine configured to present a slot-type game include a symbol replacement feature. A first set of game symbols is displayed. If a replacement symbol triggering event occurs, such as the appearance of at least one replacement symbol, the symbol replacement is triggered. At least two symbols of the first set of symbols, such as two symbols adjacent to the replacement symbol, are evaluated to determine a highest ranking and a lowest ranking symbol. A second set of symbols is then displayed, the second set of symbols comprising the first set of symbols with occurrences of the lowest ranking symbol replaced with the highest ranking symbol.

19 Claims, 2 Drawing Sheets

(56) References Cited

U.S. PATENT DOCUMENTS

| | | | | |
|---|---|---|---|---|
| 2011/0212768 | A1* | 9/2011 | Baerlocher | G07F 17/32 463/27 |
| 2012/0046089 | A1 | 2/2012 | Kemper | |
| 2013/0053118 | A1* | 2/2013 | Schueller | G07F 17/3218 463/17 |
| 2013/0310146 | A1 | 11/2013 | Hoffman | |
| 2013/0344939 | A1 | 12/2013 | Aoki | |
| 2014/0274294 | A1* | 9/2014 | Baerlocher | G07F 17/34 463/20 |

* cited by examiner

GAMES AND GAMING MACHINES HAVING GAME SYMBOL REPLACEMENT FEATURE

FIELD OF THE INVENTION

The present invention relates to methods of presenting and playing games and gaming machines configured to present games.

BACKGROUND OF THE INVENTION

One popular type of game is the video slot game. In accordance with this game, video representations of reels bearing game symbols are displayed. A winning outcome of the game may result when certain combinations of symbols are displayed by the reels, such as certain combinations of symbols along one or more pay lines or scattered across the reels.

Hundreds of variations of video slot games have been developed. These variations may have features which are designed to make the game more exciting to the player, more profitable to the operator or the like. For example, "themed" video slot games have been developed where the game symbols are associated with a particular them, such as a particular movie. These slot machines thus appeal to players who like the particular theme.

Other video slot games include bonus or secondary games or other features. These features may increase the excitement of the game by introducing new elements to the game beyond the basic slot game itself.

Still, new and exciting slot games are desired.

SUMMARY OF THE INVENTION

Embodiments of the invention comprise methods of presenting and playing games and gaming machines and systems configured to present games. One embodiment of the invention comprises a game and gaming machine having a symbol replacement feature.

In accordance with one embodiment of the invention, a first set of game symbols is selected and/or displayed. It is determined if a symbol replacement triggering event has occurred, such as the appearance of at least one replacement or "clone" symbol in the first set of symbols. If the triggering event did not occur, then the game continues normally, such as by evaluating the first set of symbols for winning outcomes.

If the triggering event has occurred, at least two symbols of the first set of symbols are evaluated to determine relative ranks of those symbols. In an embodiment where the symbol replacement triggering event comprises the receipt of at least one replacement symbol, one or more symbols adjacent to that symbol may be evaluated. In a preferred embodiment, the symbols to the left and right side of the clone symbol are evaluated.

In one embodiment, the ranks of the evaluated symbols are determined with reference to a table or hierarchy, such as by reference to the value of the symbols as defined by a pay table. Preferably, the highest and lowest ranking symbols of the symbols which are evaluated are determined.

A second set of symbols is then generated displayed, the second set of symbols comprising the first set of symbols with occurrences of the lower/lowest ranking symbol replaced with the higher/highest ranking symbol. In this manner, certain symbols having a low value are replaced with symbols having a higher value. This second set of symbols may then be evaluated for winning outcomes.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games. In a preferred embodiment, the methods of game play and presentation are implemented via a gaming machine or device. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
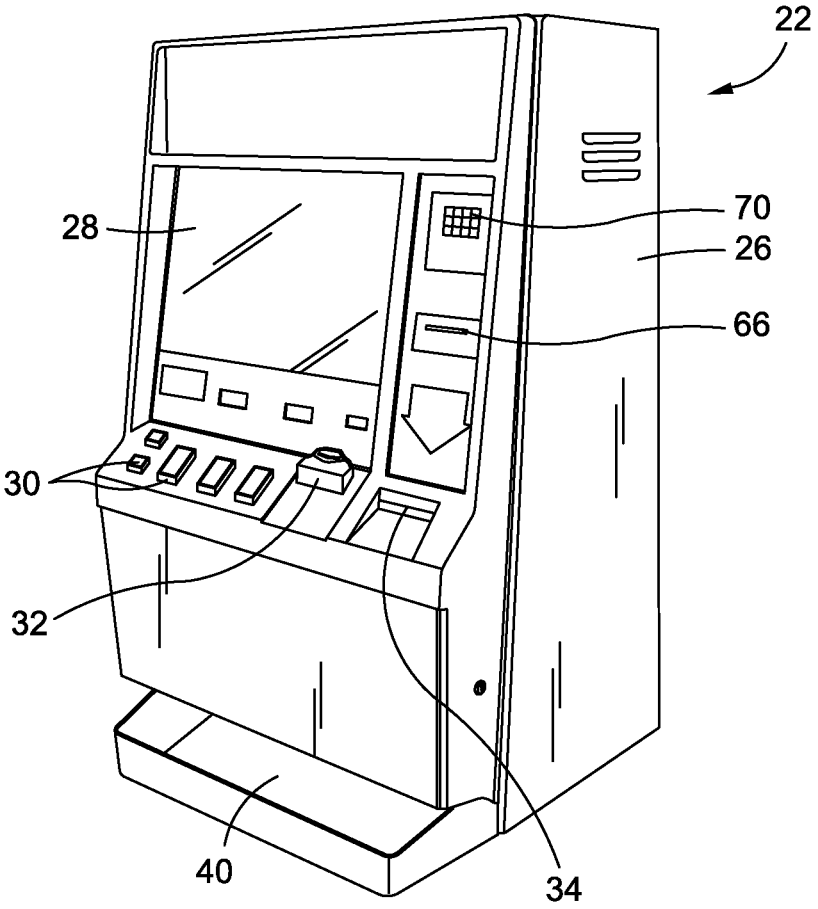
FIG. 1 illustrates a gaming machine in accordance with one embodiment of the invention.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

As described in more detail below, the gaming machine 22 is preferably configured to present one or more games upon a player making a monetary payment or wager. In this regard, as described in more detail below, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information comprising game symbols, such as associated with one or more video-represented reels, as detailed below), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting game symbols or game outcomes and for presenting the game in a random fashion (e.g. whereby the game is presented in a manner in which the player cannot control the outcome).

Preferably, the controller is configured to execute machine readable code or instructions which are configured to implement the method of game play of the invention. For example, the controller of the gaming machine 22 may be configured to detect a wager, such as a signal from a player's depressing of the "bet one" button. Upon such an event and/or the player otherwise signaling the gaming machine to present the game, the controller may be configured to cause game symbols or other game information to be displayed on the at least one display 28. The controller may accept input from a player of game inputs, such as a request to spin reels or the like, via the one or more player input devices of the gaming machine 22.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a player tracking device, such as a card reader 66 and associated keypad 70. Such player tracking devices are well known and may permit the game operator to track play of players of the gaming machine. The tracked play may be utilized to offer player bonuses or awards.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIG. 1 is only exemplary of one embodiment of a gaming machine. For example, it is possible to for the gaming machine to have various other configurations, including different shapes and styles and having different components than as just described.

For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

Figure 2:
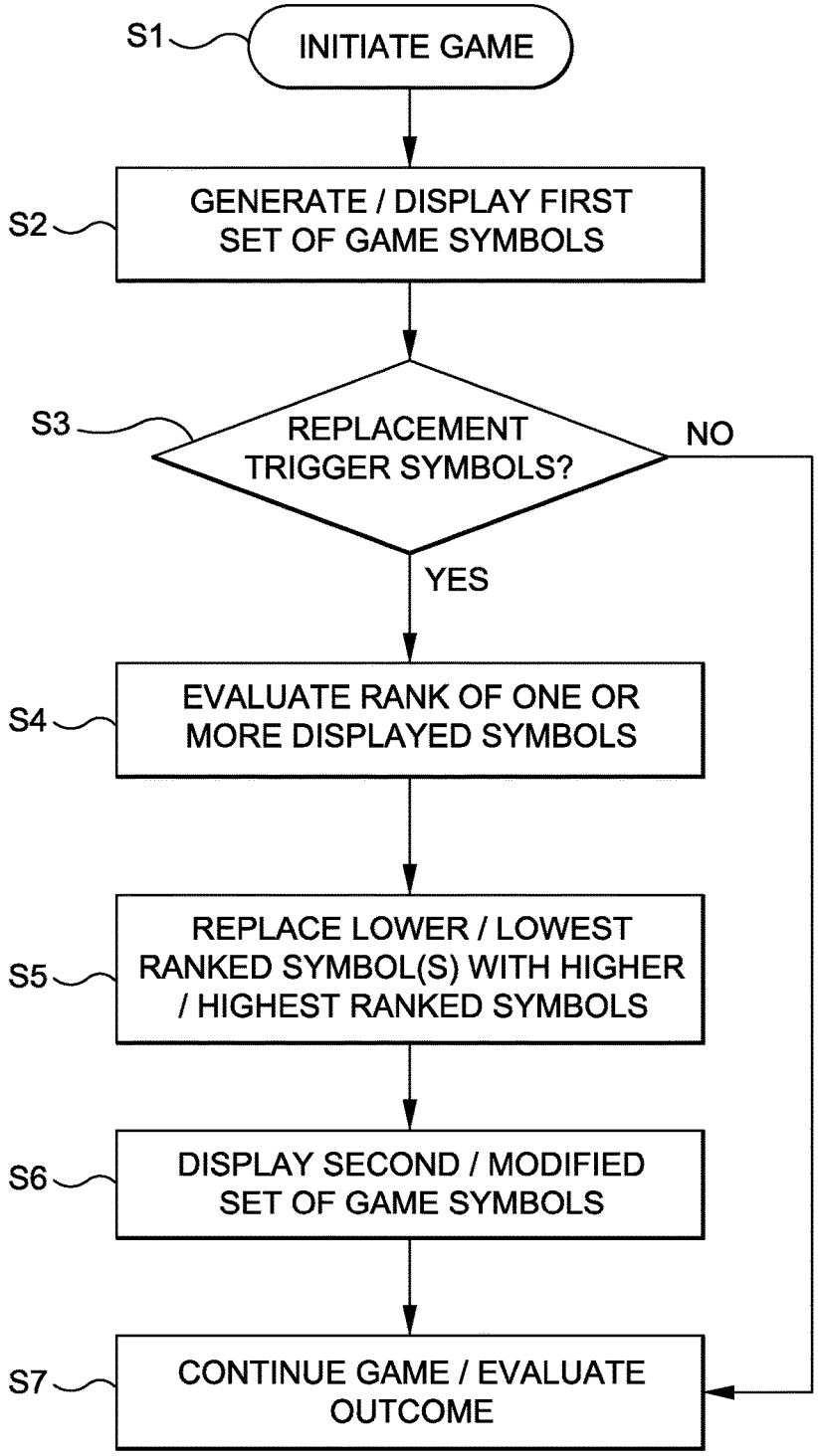
FIG. 2 is a flow chart which illustrates a method of presenting a game in accordance with the invention.

One embodiment of a method of playing and presenting a game in accordance with an embodiment of the invention will be described with reference to FIG. 2. In a step S1, a game is initiated. In one embodiment, as described above, the game may be presented as a wagering game. In such an instance, a player may be required to place at least one wager. The wager might comprise monies, monetary value credits, points or the like. Thus, the step of initiating the game might comprise the step of a player placing a wager, such as a required minimum wager. This step might alternatively, or additionally comprise the step of a player providing a play input, such as via a button or other input device (such as a start game, spin or other button of a gaming device).

In a step S2, a first set of two or more game symbols is generated and/or displayed. The game symbols may be displayed in various fashions, such as in a matrix or grid. As one example, a matrix of m rows by n columns, wherein at least one of n or m is greater than 1, may be utilized. Common examples of symbol matrices have sizes of 3 rows×3 columns, 3 rows×5 columns and the like. Again, however, m or n may be larger or smaller than 3 or 5. In addition, it is possible for the game symbols to be displayed in other arrangements, such as in a pyramid shape, etc.

In one embodiment, the game symbols are associated with reels or reel strips. In a virtual or computer-implemented version of a reel environment, each reel strip is a virtual reel which defines a plurality of symbol locations. Each symbol location is filled with or has an associated symbol, such as selected from a set of two or more different symbols. Each column of the matrix or grid may be associated with one of the reels, wherein the matrix or grid displays one or more of the symbols associated with positions of the reel corresponding to that column.

The game symbols comprising the first set of game symbols may be selected in various fashions, as is well known in the art. For example, the symbols may be selected based upon one or more random numbers. The random number(s) may be generated by one or more random number generators. The random numbers may be used to select individual symbols or sets of symbols for display, either directly or corresponding to one or more selected outcomes. For example, random numbers may be utilized to randomly select reel stops or positions for each reel and then the corresponding game symbols corresponding to those locations may be displayed.

It will be appreciated that the game may be played with a number of different symbols. The symbols may have a variety of appearances, such as comprising icons which have the appearance of cards, various objects or the like. In one embodiment, the symbols which are displayed to the player may be selected from at least one set of game symbols, which set comprises a plurality of different symbols.

In a step S3, it is determined if a symbol replacement trigger has occurred. In one embodiment, the symbol replacement trigger comprises the selection and/or display of one or more designated symbols. In a preferred embodiment, the designated symbol comprises a replacement symbol. As used herein, this symbol may be referred to as a clone symbol in that this symbol has the effect of causing at least one game symbol to be cloned or replicated in the game. This clone symbol may have an appearance which is different than other of the symbols used in the game.

Of course, the replacement trigger might comprise other triggers, such as the random select of a particular symbol or matrix position, a secondary selection, or other types of events. In this regard, the triggering event might occur before the first set of symbols are selected, during the selection of the first set of symbols, or thereafter. For example, in one embodiment a random number generator might be used to select a random number which is used to trigger or not trigger the event, where after the first set of symbols might be selected and displayed.

If the replacement trigger does not occur or result, then the game may continue normally, as described in more detail below relative to step S7.

If the symbol replacement trigger has occurred or resulted, then in a step S4, the rank of two or more of the symbols of the first set of symbols is evaluated. It is possible to evaluate the rank of all of the selected or displayed symbols. However, in an embodiment where the symbol replacement trigger comprises a clone symbol, the evaluation may comprise determining the rank of one or more symbols which are adjacent to the clone symbol. In a matrix where the symbols are arranged into rows and columns, the adjacent symbols may comprise those symbols which are to the left, right, top, bottom or diagonal to the clone symbol, or a combination thereof (such as to the left and right, up and down, etc.). Of course, when the symbols are arranged in other fashions, other evaluations may be utilized. In the case of a matrix or grid of symbols, when the clone symbol is located at an edge of the matrix or grid, the adjacent symbol may be the symbol at the opposing side of the matrix or grid (for example, if the clone symbol is at the left-most side of the grid—e.g. in the first column, the symbol to the left of the clone symbol may be that symbol at the right-most side of the grid—e.g. in the last column, in the same row as the clone symbol).

In one embodiment, the game symbols are ranked, e.g. have a hierarchy. The ranking may correspond, for example, to a value of the symbol s in a pay table. In this configuration, the ranking of a symbol may depend upon its pay value, wherein a higher paying symbol has a higher rank than a lower paying symbol. Regardless, the game symbols are preferably ranked.

As indicated, the rank of two or more of the displayed game symbols is evaluated. It will be appreciated that not all of the game symbols may be selected or displayed relative to a particular game. Thus, the highest and lowest ranking symbol which appears in each game may vary. In a preferred embodiment, two of the symbols from the first set of symbols are evaluated to determine which of the evaluated symbols has the highest rank and which has the lowest rank. In other embodiments, three or more symbols might be evaluated.

In a step S5, one or more lower ranked symbol(s) (in the selected or displayed symbol set) are replaced with the highest ranked symbol (in the selected or displayed symbol set). In one embodiment, one of the lower ranked symbols which is determined from the evaluation in step S4 is replaced with one of the higher ranked symbol as determined from the evaluation in step S4. In a preferred embodiment, all occurrences of the lowest ranked symbol in the first set of symbols as determined by the evaluating step are replaced with the highest ranked symbol as determined by the evaluating step. As indicated herein, however, other configurations of replacement could occur, such as by replacing the second lowest ranking symbol with the second highest ranking symbol, replacing the second highest ranking symbol with the highest ranking symbol. In all cases, however, the replacement step is based upon a ranking of symbols as determined by the evaluating step.

In one embodiment, each occurrence of the lower/lowest ranked symbol in the first set of symbols is replaced with the higher/highest ranked symbol. In other embodiments, only the lower/lowest ranked symbols in certain locations (such as in certain rows or columns, in positions close to the clone symbol, etc.) might be replaced, or there might be a numerical limit on the number of replacements or the replacement might be by user selection, etc.

As a result of the symbol replacement step, a second set of symbols results. This second set of symbols is preferably displayed to the player, such as in accordance with step S6. While the first set of symbols does not need to be displayed to the player (the first set might be selected internally), it is preferred that the first set of symbols be displayed to the player along with the symbol replacement so that the player can see the effect of the symbol replacement feature causing the first set of symbols to be improved by having lower ranked symbols replaced with higher ranked symbols.

In a step S7, the game then continues. In one embodiment, this may comprise evaluating a final set of symbols. In the case of play of the game where the symbol replacement feature was not triggered, the final set of symbols may comprise the first set of symbols. In the case where the symbol replacement feature was triggered, the final set of symbols may comprise the second set of symbols as described above. In either event, the final set of symbols might include other modifications to the first or second sets of symbols, such as because of other game features or events. For example, regardless of whether the symbol replacement feature is triggered, a random wild feature might be triggered which causes one or more symbols to turn to wild and thus otherwise modify the symbols.

In one embodiment, one or more combinations of symbols, but not all, are designated as winning combinations (the other combinations may be designated as non-winning or "losing"). Such combinations might comprise a single occurrence of a symbol, multiple combinations of the same symbol, or combinations of two or more different symbols. In one embodiment, the symbols may be evaluated for winning combinations along only designated pay lines, or may be evaluated relative to any position. The final set of game symbols may thus be evaluated for one or more winning symbol combinations.

In one embodiment, one or more awards may be awarded for winning symbol combinations. For example, a monetary, monetary value credit or points award may be awarded for a winning outcome. The award(s) may be defined by one or more pay tables of winning outcomes. Such a pay table may set forth each winning combination of game symbol(s) and its associated award.

Various examples of the invention, as well as additional aspects of the invention, will now be described.

Example A

In this example, the game symbols are ranked from highest to lowest: ♠, ♥, ♦, ♣. The clone or replacement trigger symbol is represented by C. Table 1 illustrates an initial or first set of selected game symbols for a game which displays game symbols in a 5 (columns)×3 (rows) matrix.

TABLE 1

| | | | | |
|---|---|---|---|---|
| ♦ | ♠ | ♥ | ♣ | ♦ |
| ♥ | C | ♣ | ♥ | ♠ |
| ♠ | ♥ | ♦ | ♣ | ♣ |

In this example, the symbol replacement trigger has occurred (the selection or appearance of the clone symbol C in cell (column 2, row 2)). In this example, only symbols to the left and right of the clone symbol C are evaluated for their rank: the ♥ in cell (1,2) and the ♣ in cell (3,2). Since the ♥ symbol is ranked higher than ♣ the symbol, all instances of the ♣ symbol in the initial set of displayed symbols are replaced with the ♥ symbol.

Thus, the ♣ symbols in cells (4,1), (4,3), (3,2) and (5,3) will be replaced with ♥ symbols. Table 2 illustrates the final set of game symbols after this replacement.

TABLE 2

| | | | | |
|---|---|---|---|---|
| ♦ | ♠ | ♥ | ♥ | ♦ |
| ♥ | C | ♥ | ♥ | ♠ |
| ♠ | ♥ | ♦ | ♠ | ♥ |

This final set of symbols is then evaluated for winning outcomes or otherwise defines the outcome of the game.

Example B

As one aspect of the invention, if the symbols being evaluated (such as the symbols adjacent to the triggering symbols(s)) are of the same rank, then a special modifier may be implemented, such as replacing all instances of the lowest ranking symbol with a wild symbol (e.g. a symbol having the characteristic of being the same as any other symbol) or applying a payout multiplier to the evaluation of the current spin.

In this example, the game symbols are again ranked from highest to lowest: ♠, ♥, ♦, ♣. The cloning symbol is represented by C and it is evaluated only adjacent symbols to the left and right of its position.

Table 3 illustrates an initial or first set of selected game symbols for a game which displays game symbols in a 5 (columns)×3 (rows) matrix.

TABLE 3

| | | | | |
|---|---|---|---|---|
| ♦ | ♠ | ♥ | ♣ | ♦ |
| ♣ | C | ♣ | ♥ | ♠ |
| ♠ | ♥ | ♦ | ♣ | ♣ |

The initial set of game symbols includes the trigger or clone symbol C (in cell (2,2)). In this example in which the symbols to the left and right of the clone symbol position are evaluated, the symbols are the same: the ♣ in cell (1,2) and the ♣ in cell (3,2). Since both symbols are of the same rank, the game may decide to replace all instances of the ♣ symbol with a wild symbol.

Table 4 illustrates the final set of game symbols after this replacement (which final set of game symbols may be evaluated for potential wins).

TABLE 4

| | | | | |
|---|---|---|---|---|
| ♦ | ♠ | ♥ | WILD | ♦ |
| WILD | C | WILD | ♥ | ♠ |
| ♠ | ♥ | ♦ | WILD | WILD |

Example C

As another example of the invention, the initial set of symbols may comprise multiple triggers, such as multiple clone symbols. In one embodiment, if this occurs, the clone symbols may be processed one at a time, whereby substitutions made by an earlier clone symbol or trigger may affect the symbol evaluation of another clone symbol or trigger.

In this example, the game symbols are again ranked from highest to lowest: ♠, ♥, ♦, ♣. The clone symbol is represented by C.

Table 5 illustrates an initial or first set of selected game symbols for a game which displays game symbols in a 5 (columns)×3 (rows) matrix.

TABLE 5

| | | | | |
|---|---|---|---|---|
| ♦ | ♠ | ♠ | $C_2$ | ♣ |
| ♥ | $C_1$ | ♣ | ♥ | ♦ |
| ♠ | ♥ | ♦ | ♣ | ♥ |

In this example, the initial set of game symbols includes two triggers or clone symbols. The clone symbol $C_1$ in cell (2,2) will evaluate adjacent symbols to the left and right of its position: the ♥ symbol in cell (1,2) and the ♣ symbol in cell (3,2). Since the ♥ symbol is ranked higher than ♣ the symbol, all instances of the ♣ symbol are replaced with the ♥ symbol. The ♣ symbols in cells (5,1), (3,2) and (4,3) will be replaced with ♥ symbols.

The first substitution results in the modified set of game symbols set forth in Table 6.

TABLE 6

| | | | | |
|---|---|---|---|---|
| ♦ | ♠ | ♠ | $C_2$ | ♥ |
| ♥ | $C_1$ | ♥ | ♥ | ♦ |
| ♠ | ♥ | ♦ | ♥ | ♥ |

The clone symbol $C_2$ in cell (4,1) then evaluates the adjacent symbols to the left and right of its position: the ♠ symbol in cell (3,1) and the ♥ symbol in cell (5,1) that was originally a ♣ prior to the previous substitution. Since the ♠ symbol ranks higher than the ♥ symbol, all instances of the ♥ symbol are replaced with the ♠ symbol (e.g. the ♥ symbols in cells (5,1), (1,2), (3,2), (4,2), (2,3), (4,3) and (5,3) are replaced with ♠ symbols).

Table 7 illustrates the final set of game symbols after this replacement (which final set of symbols may be evaluated for potential winning outcomes).

TABLE 7

| | | | | |
|---|---|---|---|---|
| ♦ | ♠ | ♠ | $C_2$ | ♠ |
| ♠ | $C_1$ | ♠ | ♠ | ♦ |
| ♠ | ♠ | ♦ | ♠ | ♠ |

Example D

In one embodiment, a triggering symbol, such as a clone symbol, may appear anywhere in the set of displayed symbols. In other embodiments, the symbol might only appear in specific positions, such as in particular columns, rows or designated individual positions.

As one example, if the game allows for a clone symbol to appear on adjacent columns (for example, in columns 2, 3 and 4), then two clone symbols appearing adjacent to one another may be treated as one clone symbol spanning multiple positions, thus affecting the appropriately adjacent symbols (for purposes of the symbol rank evaluation).

Once again, in this example, the symbols are ranked from highest to lowest: ♠, ♥, ♦, ♣. The cloning symbol is represented by C and it is evaluated only relative to adjacent symbols to the left and right of its position.

Table 8 illustrates an initial or first set of selected game symbols for a game which displays game symbols in a 5 (columns)×3 (rows) matrix.

TABLE 8

| | | | | |
|---|---|---|---|---|
| ♦ | ♠ | ♣ | ♦ | ♣ |
| ♥ | $C_1$ | $C_2$ | ♣ | ♦ |
| ♠ | ♥ | ♦ | ♥ | ♥ |

The clone symbol $C_1$ in cell (2,2) is adjacent to the cloning symbol $C_2$ in cell (3,2). In this case, both clone symbols will be treated as a single symbol. Thus, in the example where the symbols to the left and right of the clone symbol are evaluated for rank, the symbol to the left of the left-most clone symbol is evaluated, as is the symbol to the right of the right-most clone symbol, e.g. the ♥ symbol in cell (1,2) and the ♣ symbol in cell (4,2). Since the ♥ symbol is ranked higher than ♣ the symbol, all instances of the ♣ symbol are replaced with the ♥ symbol. The ♣ symbols in cells (3,1), (5,1) and (4,2) will be replaced with ♥ symbols.

Table 9 illustrates the final set of game symbols after this replacement:

TABLE 9

| | | | | |
|---|---|---|---|---|
| ♦ | ♠ | ♥ | ♦ | ♥ |
| ♥ | $C_1$ | $C_2$ | ♥ | ♦ |
| ♠ | ♥ | ♦ | ♥ | ♥ |

Other Aspects

The symbol substitution performed by symbol replacement feature may only be temporary by affecting only the symbols relative to the existing game. In this case, the reel strips/positions are restored to their original symbol sets for all future spins.

Alternately, the substitution could modify the reel strips such that the symbol replacement affects all symbols of that type on the reel strip for subsequent spins. This substitution remains in effect until an event (such as the end of a bonus game) causes the reel strips to be restored to their original symbol set. This has the effect of systematically eliminating lower paying symbol combinations for subsequent spins by replacing those symbols with higher paying symbols.

The symbol replacement feature of the invention may be implemented relative to a base game or other types of games or events. For example, the symbol replacement feature might be implemented relative to a bonus slot-type game. As one example, one or more base games might be presented. Such games might comprise slot type games or other types of games. At one or more times, one or more bonus games may be triggered and/or presented. The bonus games might comprise wagering events or might be presented without the requirement of a wager. Such bonus games might comprise instances of slot type games having the trigger, rank evaluation and symbol replacement feature of the present invention.

In one embodiment, the triggering event for the symbol replacement feature of the invention may comprise the receipt of a particular symbol. This symbol may comprise a unique clone symbol as described above. In such an embodiment, the clone symbol may have the characteristics of one or more of the other game symbols for purposes of determining the outcome of the game (e.g. relative to the evaluation of the symbols for winning outcomes). For example, in one embodiment, the clone symbol might have the characteristic of triggering the symbol rank evaluation and replacement feature and then have the characteristic of a wild symbol for purposes of symbol evaluation for winning outcome purposes.

For example, Table 9 above set forth a final set of game symbols. In this example, the two clone symbols may be treated as wild, such that for symbol evaluation purposes, the final set of symbols is evaluated as though they have the characteristics as set forth in Table 10.

TABLE 10

| | | | | |
|---|---|---|---|---|
| ♦ | ♠ | ♥ | ♦ | ♥ |
| ♥ | WILD | WILD | ♥ | ♦ |
| ♠ | ♥ | ♦ | ♥ | ♥ |

In other embodiments, it is possible for the triggering event or symbol to be a secondary symbol or designator. For example, one of the game symbols may be displayed in each of the symbol positions of the matrix. An additional triggering symbol or designator, such as a colored background or the like might be used to designate or trigger the symbol replacement feature of the invention. In that event, the outcome of the game may be evaluated relative to the symbols displayed after the symbol replacement, including with reference to the symbol displayed in the position of the trigger. Such a configuration is illustrated in Table 11.

TABLE 11

| | | | | |
|---|---|---|---|---|
| ♦ | ♠ | ♥ | ♣ | ♥ |
| ♥ | ♥ T | ♦ | ♥ | ♦ |
| ♠ | ♥ | ♦ | ♥ | ♥ |

In this example, the T symbol represents the symbol replacement trigger. When the final set of symbols is evaluated, the evaluation is made using the ♥ symbol in cell (2,2). The T symbol might be randomly placed in the matrix, for example.

The present invention has numerous advantages. As one aspect of the invention, a slot-type game is made more exciting to the player because it provides the player with the opportunity for higher winnings. In particular, a first set of game symbols may be modified so that lower value or ranked symbols are replaced with higher ones, providing the player with an opportunity for increased winnings. The symbol replacement feature may be displayed to the player, increasing the excitement of the game to the player.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method for conducting a raffle comprising:

reading an item identifier from an identification tag affixed to an item using a processor or processors at an equipment management system, prior to an event related to the item;

transmitting raffle notification data to a plurality of devices using the processor or processors if it is determined that the event has occurred, where the raffle notification data includes item identification data for the item;

receiving a plurality of raffle ticket requests from the plurality of devices at the processor or processors in response to the raffle notification data;

processing a plurality of raffle ticket sales for the plurality of ticket requests using the processor or processors;

delivering a plurality of raffle tickets to the plurality of devices using the processor or processors;

selecting one of the plurality of raffle tickets and transmitting winning notification data to the associated device using the processor or processors;

reading the item identifier from the identification tag affixed to the item after the event using the equipment management system and the processor or processors;

providing authentication data to one of the plurality of devices to verify that the item was in use during the event using the processor or processors.

2. The gaming machine in accordance with claim 1 further comprising machine-readable code executable by said controller to cause said controller to determine an outcome of said game relative to second set of game symbols.

3. The gaming machine in accordance with claim 1 wherein said adjacent positions touch a position of said at least one triggering symbol.

4. The gaming machine in accordance with claim 3 wherein said first set of symbols is arranged as a matrix of symbols in m rows and n columns and said at least two other symbols comprise the symbols to the left and right of the at least one triggering symbol.

5. The gaming machine in accordance with claim 1 wherein said at least one triggering symbol is treated as a wild symbol in said second set of symbols.

6. The gaming machine in accordance with claim 1 wherein said symbols are ranked in accordance with a pay table.

7. The gaming machine in accordance with claim 1 wherein said first set of symbols is display as part of a base game.

8. The gaming machine in accordance with claim 7 further comprising machine-readable code executable by said controller to cause said at least one electronic video display to display a first set of game symbols in response to a wager placed by a player of said gaming machine.

9. The gaming machine in accordance with claim 1 wherein said first set of symbols is displayed as part of presentation of at least one bonus game.

10. A method of presenting a game at an electronically operated gaming machine having at least one electronic video display, a monetary funds accepting mechanism and at least one player input device, comprising the steps of:

accepting monetary funds provided by a player to said monetary funds accepting mechanism;

generating a player credit balance based upon said monetary funds;

receiving at least one input from said player via said at least one player input device to place a wager and initiate said game;

displaying a first set of game symbols in symbol positions via said at least one electronic video display;

determining if at least one triggering symbol appears in said first set of game symbols, if so, comparing the ranks of at least two other symbols which are in adjacent positions to said at least one triggering symbol in said first set of game symbols to determine which of said at least two symbols has a highest rank and which of said at least two symbols has a lowest rank;

displaying a second set of game symbols via said at least one electronic video display, said second set of game symbols comprising said first set of game symbols with each occurrence of said symbol having said determined lowest rank replaced with said symbol having said highest determined rank; and increasing said player credit balance when said second set of game symbols defines at least one winning game outcome.

11. The method in accordance with claim 10 wherein said replacement symbol triggering event comprises the appearance of at least one replacement symbol in said first set of symbols.

12. The method in accordance with claim 11 wherein said at least two symbols are in adjacent positions which touch said at least one triggering symbol.

13. The method in accordance with claim 12 wherein said symbols of said first set of symbols are displayed in a grid and said at least two symbols are to the left and right of said replacement symbol.

14. A method for conducting a raffle comprising:

reading an item identifier from an identification tag affixed to an item at an equipment management system using a processor or processors, prior to an event related to the item;

transmitting raffle notification data to a display using the processor or processors;

receiving a plurality of raffle ticket requests from the plurality of devices at the processor or processors in response to the raffle notification data;

processing a plurality of raffle ticket sales for the plurality of ticket requests using the processor or processors;

delivering a plurality of raffle tickets to the plurality of devices using the processor or processors;

selecting one of the plurality of raffle tickets and transmitting winning notification data to the associated device using the processor or processors;

reading the item identifier from the identification tag affixed to the item after the event using the equipment management system using the processor or processors;

providing authentication data to one of the plurality of devices to verify that the item was in use during the event using the processor or processors.

15. The method in accordance with claim 10 wherein if no replacement symbol triggering event has occurred, evaluating said first set of symbols for a winning outcome.

16. The method in accordance with claim 10 further comprising the step of evaluating said second set of symbols for a winning outcome.

17. The method in accordance with claim 16 wherein said replacement symbol triggering event comprises the appearance of at least one replacement symbol and said replacement symbol is treated as a wild symbol for purposes of said step of evaluating said second set of symbols for a winning outcome.

18. The method in accordance with claim 10 wherein said first set of symbols is displayed in a grid of m rows by n columns, wherein each column is associated with a virtual slot reel having a plurality of symbol positions.

19. The method in accordance with claim 18 wherein said plurality of symbol positions are populated by game symbols selected from a set of two or more game symbols and at least one replacement symbol.

* * * * *